US006070491A

United States Patent [19]

Claudio et al.

[11] Patent Number: 6,070,491

[45] Date of Patent: Jun. 6, 2000

[54] JACK EXTENSION HANDLE

[75] Inventors: Mark A. Claudio, Bryan; Wayne Adkins, Oakwood; James F. VanUum, Olmstead Township, all of Ohio

[73] Assignee: Edgerton Forge, Inc., Edgerton, Ohio

[21] Appl. No.: 08/832,531

[22] Filed: Apr. 3, 1997

[51] Int. Cl.[7] ..... G05G 1/00; A47B 95/02

[52] U.S. Cl. ..... 74/546; 403/104; 16/115

[58] Field of Search ..... 81/57.29; 403/104; 439/370; 287/119; 141/383; 74/501.5 R, 546, 547; 16/263, 114 R, 111 R, 115; 604/111, 174

[56] References Cited

U.S. PATENT DOCUMENTS

| | | | |
|---|---|---|---|
| 1,245,921 | 11/1917 | Holdren | 81/57.29 |
| 1,262,483 | 4/1918 | Hall | 403/104 |
| 1,989,823 | 2/1935 | Raabe | 439/370 |
| 2,892,503 | 6/1959 | Hood | 170/173 |
| 3,118,696 | 1/1964 | Resare | 287/119 |
| 4,132,489 | 1/1979 | Berg | 403/305 |
| 4,333,505 | 6/1982 | Jones et al. | 141/383 |
| 4,542,558 | 9/1985 | Brockhaus | 16/263 |
| 4,543,849 | 10/1985 | Yamamoto et al. | 74/501.5 R |
| 4,631,056 | 12/1986 | Dye | 604/111 |
| 4,663,796 | 5/1987 | Helling et al. | 15/144 A |
| 4,715,089 | 12/1987 | Schema | 16/115 |
| 4,788,740 | 12/1988 | Sovis et al. | 15/339 |
| 4,826,486 | 5/1989 | Palsrok et al. | 604/174 |
| 4,926,522 | 5/1990 | Wang | 16/114 R |
| 4,997,421 | 3/1991 | Palsrok et al. | 604/174 |
| 5,237,890 | 8/1993 | Gill | 74/546 |
| 5,301,389 | 4/1994 | Engel et al. | 16/114 R |
| 5,381,707 | 1/1995 | Gill | 74/546 |
| 5,425,154 | 6/1995 | Edwards | 16/111 R |
| 5,579,558 | 12/1996 | Newman | 16/115 |
| 5,823,067 | 10/1998 | Clarys et al. | 74/547 X |

*Primary Examiner*—Vinh T. Luong
*Attorney, Agent, or Firm*—Baker & Daniels

[57] ABSTRACT

A jack extension handle assembly that includes first and second elongated segments or extensions connectable together to provide a stable, extended jack handle. At the end of its solid rod-shaped body, one handle extension includes a tapered plug connector. A tapered socket connector at the end of the solid, rod-shaped body of the other handle extension mates with the plug connector during assembly of the handle. The plug and socket taperings account for forging tolerances so as to ensure a proper force-transmitting engagement between the handle extensions. The handle assembly also includes a retainer clip which externally mounts on the two handle extensions to prevent inadvertent separation of the handle extensions during use.

13 Claims, 6 Drawing Sheets

JACK EXTENSION HANDLE

BACKGROUND OF THE INVENTION

The present invention pertains to jacks utilized to move heavy objects, and, in particular, to an elongated handle for a jack that allows a user to operate the jack from a relatively distant or remote location.

Jacks are available in a variety of different shapes and sizes and serve as portable devices capable of lifting heavy loads through short distances with reduced effort. Jacks are standard accessories in automobiles and trucks to allow people to raise or jack-up their vehicles to, for example, change tires. To operate these types of jacks, their handles frequently require rotation to provide a rotary input to components of the jacks. In some cases, the handles are used as lever arms and are operated via a pumping action to control jack operation.

Due to the structural configuration of many vehicles, frequently a jack must be positioned well beneath the vehicle to abut the appropriate portion of the underside of that vehicle. Consequently, elongated handles are required to control the jack in a convenient fashion beyond the periphery of the vehicle.

Several types of elongated handles have previously been provided. One type of jack extension handle comprises an elongated, one-piece rod which allows for operation of a jack inserted far beneath a vehicle. While perhaps functional, storage of the one-piece elongated handle within the vehicle is problematic. To conform to the available storage space, the handle is formed with a variety of bends or angles in multiple planes to fit around other vehicle components. Consequently, the handle is undesirably unwieldy.

Another known extension handle is stored as two parts and assembled for use. A first, forged solid rod which attaches to the jack at one end includes a keyed socket at its other end. A second, forged solid rod includes a flattened plug at one end that inserts into the keyed socket. The end of the second rod opposite the plug is keyed and fits into a keyed hole in a lug wrench that may be used to rotate the assembled extension handle. Locking together of the first and second rods in an operational position is accomplished by a thumb screw within a tapped, transverse hole in the first rod which extends into the socket to engage the plug. While effective, operating the thumb screw may be complicated by dirt, or by paint which covers the rods, that may enter the threads.

Other extension handles, such as disclosed in U.S. Pat. No. 5,237,890, involve tubular members, typically formed of metal, which can be disassembled into their separate parts to facilitate storage. Each of these handles includes a first piece with a female end with a square or hexagonal socket, and a second piece with a complimentarily formed male end which inserts and is locked into the female end. The connected male and female ends are releasably locked together with biased, projecting buttons or pins that form part of the handle pieces. A significant shortcoming of these devices is that their tubular construction is relatively expensive and therefore undesirable. In particular, as a jack is seldom needed by a customer and is therefore not a particularly strong selling point for any vehicle, vehicle manufacturers desire to minimize the cost of jack assemblies.

Still another elongated handle employs two solid rods which are hingedly connected by a rivet. One of the handle rods includes an extension portion projecting beyond the rivet which overlays the second handle rod when the elongated handle is pivoted about its rivet and unfolded to its operational position. A tubular locking member mounted on the second handle rod slides over the extension portion to lock the elongated handle in an extended position. The disadvantage of this design is that the hinge rivet, in order to provide a tight fit between the two hingedly connected parts, often results in a handle which is difficult to unfold for operation. Furthermore, when the hinge is loosely connected, the handle can rattle which creates undesirable noise within the storage compartment or trunk.

Thus, it would be desirable to provide a jack extension handle that overcomes these and other deficiencies of the prior art.

SUMMARY OF THE INVENTION

The present invention provides a jack extension handle which can be conveniently disassembled into separate parts for ready storage, and which can be properly assembled with minimal mechanical aptitude and without significant effort. The present invention employs tapered connector components which allow forged parts to be used while still ensuring a proper engagement, thereby achieving a sturdy, reliable and relatively inexpensive extension handle.

In one form thereof, the present invention provides a jack extension handle assembly including a first extension having a first elongated body and a first tapered engagement member, wherein the first elongated body comprises a rod, a second extension having a second elongated body and a second engagement member, wherein the first tapered engagement member is selectively engageable with the second engagement member, and retention means for retaining the first and second engagement members in engagement.

In another form thereof, the present invention provides the combination of a jack and a jack extension handle assembly. The jack extension handle assembly includes a first extension including first and second end portions spanned by a body that along the majority of its length is a rod. The first end portion of this extension is adapted to be operatively attachable to the jack to enable movement of a lifting element of the jack relative to the base of the jack. The first extension second end portion includes a first attachment element. The second extension includes first and second end portions spanned by a body that along the majority of its length is a rod. The second extension first end portion is adapted to receive a jack operating input force, and the second extension second end portion has a second attachment element attachable to the first attachment element to transfer input force to the first extension. One of the attachment elements is a socket and the other is a plug insertable into the socket. The first and second extensions are operatively engaged by insertion of the plug into the socket, and at least one of the socket and plug is tapered to ensure a force transmitting engagement when disposed in the operative arrangement. The first and second extensions may be disengaged for storage.

In another form thereof, the present invention provides a jack extension handle assembly including a first extension, a second extension, and a retainer clip. The first extension is attachable to a jack to enable jack operation and includes an elongated body and a first attachment element. The second extension transfers input force to the first extension and includes an elongated body and a second attachment element. One of the first and second attachment elements comprises a socket and the other comprises a plug. The first and second extensions are connectable in an operative arrangement by inserting the plug into the socket, and the first and second extensions are storable in a reduced length arrangement when the plug is removed from the socket. The retainer clip includes a first clip portion, a second clip portion and a bridging portion extending between the first and second clip portions. The first and second clip portions are attachable to the first and second extensions respectively when the extensions are arranged in the operative arrangement such that the bridging portion extends over the inserted plug and socket, whereby the retainer clip releaseably secures together the first and second extensions to prevent removal of the plug from the socket.

In still another form thereof, the present invention provides a jack extension handle assembly including a first handle extension, a second handle extension, means integrated into the first and second handle extensions for releasably interconnecting together the first and second handle extensions for transfer of rotational energy, wherein the interconnecting means includes a tapered plug and a tapered socket, and means for retaining the first and second handle extensions in an operational arrangement.

One advantage of the jack extension handle assembly of the present invention is that it allows for convenient operation of a jack positioned underneath a vehicle.

Another advantage of the present invention is that the handle assembly is economical to manufacture.

Another advantage of the present invention is that it can be readily assembled and disassembled to allow for convenient storage.

Still another advantage of the present invention is that it is durable, lightweight, and has few working parts which could fail and compromise its operation.

Still another advantage of the present invention is that the tapering of the complementary plug and socket connectors ensures a secure handle connection despite manufacturing tolerances of forged parts.

BRIEF DESCRIPTION OF THE DRAWINGS

The above mentioned and other advantages and objects of this invention, and the manner of attaining them, will become more apparent and the invention itself will be better understood by reference to the following description of embodiments of the invention taken in conjunction with the accompanying drawings, wherein.

Figure 1:
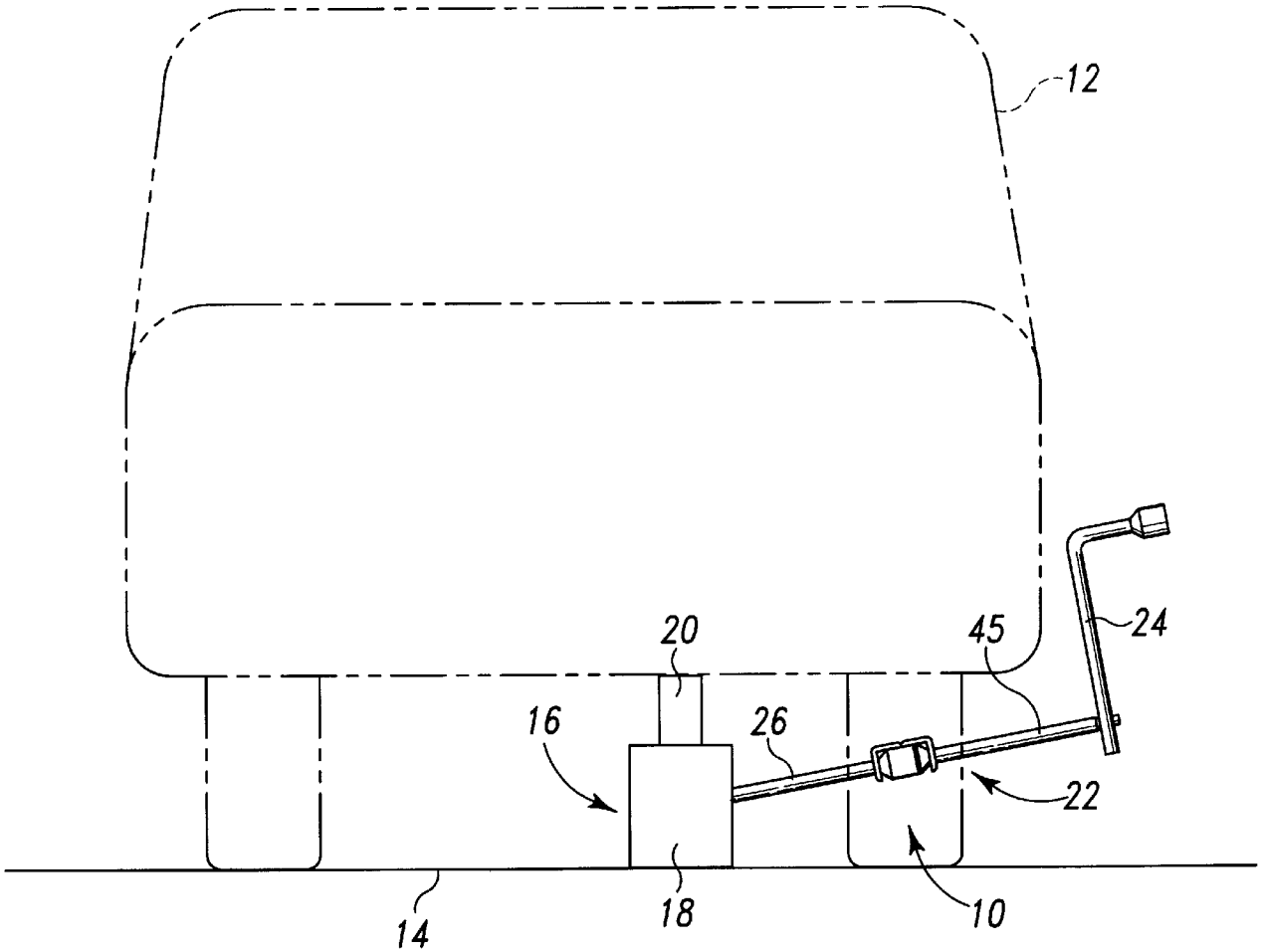
FIG. 1 is a diagrammatic front view of a jack assembly equipped with an extension handle assembly of the present invention positioned to raise a truck abstractly shown in dashed lines.

Corresponding reference characters indicate corresponding parts throughout the several views. Although the drawings represent an embodiment of the invention, the drawings are not necessarily to scale and certain features may be exaggerated or omitted in order to better illustrate and explain the present invention.

DESCRIPTION OF THE PREFERRED EMBODIMENTS

Referring now to FIG. 1, there is diagrammatically shown a jack assembly, generally designated 10, equipped with the extension handle assembly of the present invention. Jack assembly 10 is illustrated in an operative arrangement in preparation for raising or jacking up a light truck 12 shown in dashed lines. Jack assembly 10 comprises a jack 16 that includes a base 18 positionable on the ground 14 underneath truck 12 and a lifting element 20 structured to engage the underside of truck 12, such as along the front wheel axle. As is conventional, operation of jack 16 causes lifting element 20 to move relative to base 18. While FIG. 1 abstractly illustrates jack 16 as a bottle jack, the extension handle of the present invention may be adapted for use with a wide variety of jack types, for example a scissors jack, within the scope of the invention. Therefore, the above general description of jack 16 is merely illustrative and is not intended to be limiting.

Figure 3:
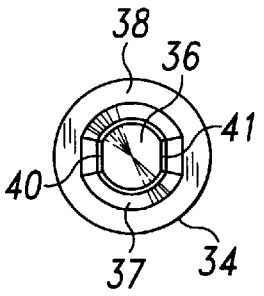
FIG. 3 is an end view of the jack side extension of FIG. 2.
Figure 2:
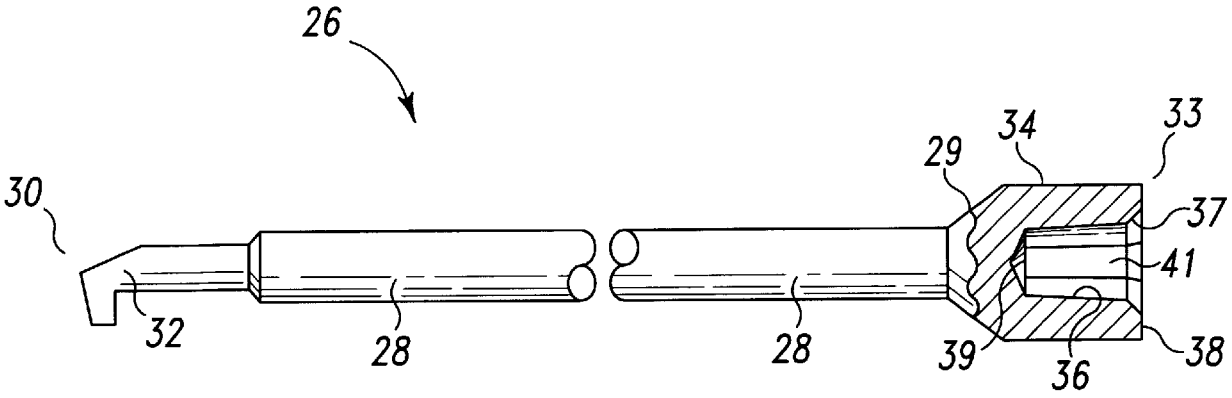
FIG. 2 is a fragmentary front view in partial cross-section of the jack side extension or segment of the extension handle assembly removed from the remainder of the jack assembly of FIG. 1.

The jack extension handle assembly, generally designated 22, extends between jack 16 and a lug wrench 24 that is manipulated as described below to control the operation of jack 16. With additional reference to FIGS. 2 and 3, a first component of extension handle assembly 22 is further shown in a front view and an end view, respectively. Jack side extension 26 extends about twenty-nine inches from end to end and is formed as a single piece with an elongated bar-shaped body 28. Body 28 is a three-eighth inch diameter rod or solid bar. Transverse cross-sectional shapes other than the circular shape shown may be provided for body 28 within the scope of the invention, and therefore the term rod is intended herein to encompass such different cross-sectional shapes. Extension 26 is forged from a strong and durable material, such as an SAE1030 or SAE1050 steel, and is covered with a black epoxy protective coating.

At one end 30, body 28 terminates with a flattened, angled hook 32. It will be recognized by the skilled artisan that hook 32 is of a known design adapted to impart or transfer the rotational motion of extension 26 to componentry within jack 16 to achieve raising and lowering of lifting element 20 relative to jack base 18. Other configurations of the jack operating end 30 may be employed within the scope of the invention. For example, differently shaped hooks, such as a looped element known as a shepherd's or sheep hook, may be substituted for angled hook 32. In addition, jack operating end 30 may be configured to operate a hydraulic jack, or to engage components of a jack designed to receive a pumping input, rather than a rotational input, when handle assembly 22 is to be used as a lever arm.

At extension end 33 that is distal from jack 16 when jack assembly 10 is operationally configured, body 28 expands or ramps at 29 to an enlarged diameter, cylindrical head 34. The surface of ramped body section 29 is oriented at about a 37° angle from the longitudinal axis of body 28. An axially extending cavity or socket 36 ports out toward end face 38 of head 34. As further shown in FIG. 3, socket 36 is generally circular in transverse cross-section but includes a pair of mirror-image, flattened sections or flats 40 and 41. Beginning at the base or reduced diameter portion of a 45° chamfered mouth region 37, socket 36 uniformly tapers inward toward extension body 28, or in other words to the left in FIG. 2, at an angle of between about 5° and 30°, and more preferably about 8°. Due to this tapering and the presence of flats 40 and 41, socket 36 is generally frustoconical in shape with two flattened sections disposed at diametrically opposite positions along the conical periphery of the socket. In a preferred embodiment where socket 36 has about a 0.500 inch axial length, at the socket outboard end proximate the base of chamfer region 37, the rounded or conical portions of socket 36 have a diametrical dimension in a range between about 0.419 inch and 0.429 inch, and the flats 40 and 41 are spaced in a range between about 0.381 inch and 0.391 inch. At the interior base or inboard end 39 of socket 36, the conical portions of socket 36 have a diametrical dimension in a range between about 0.350 inch and 0.359 inch, and the flats 40 and 41 are spaced in a range between about 0.310 inch and 0.320 inch.

Figure 5:
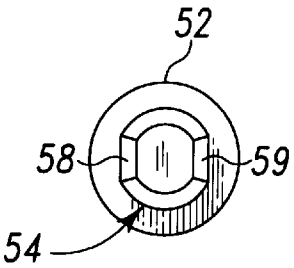
FIG. 5 is an end view of the wrench side extension of FIG. 4.
Figure 4:
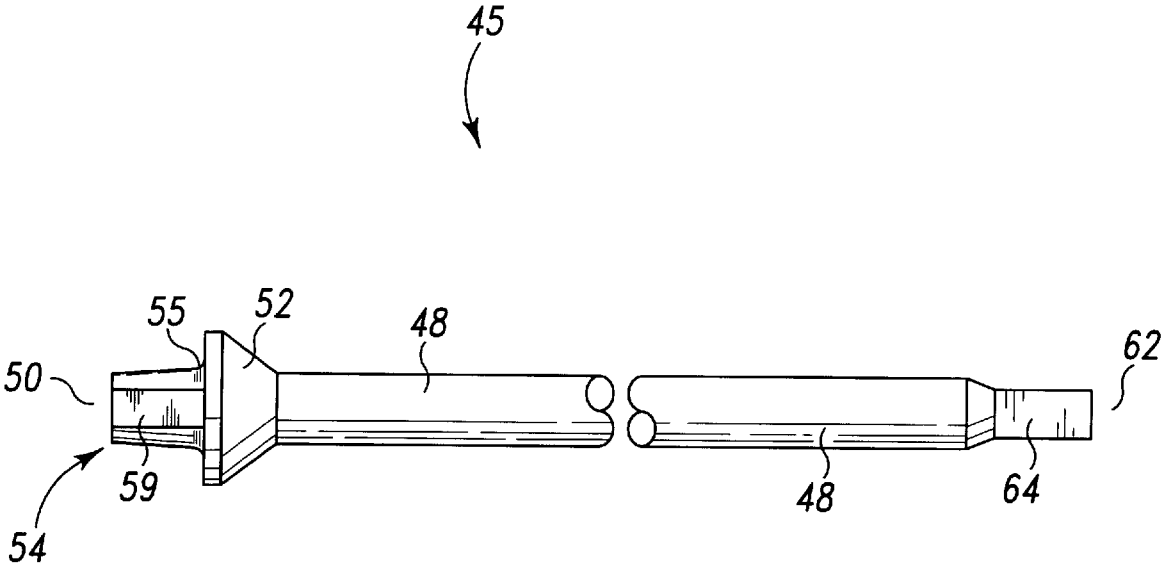
FIG. 4 is a fragmentary front view of the wrench side extension or segment of the extension handle assembly removed from the remainder of the jack assembly of FIG. 1.

Referring now to FIGS. 4 and 5, the wrench side extension 45 of jack extension handle assembly 22 extends about twenty-nine inches from end to end and is formed from the same material as jack side extension 26. The lengths of the extensions are driven by the vehicle lifting points and storage considerations. Wrench side extension 45 includes a one-piece, forged steel construction with a protective coating, and extension body 48 is a three-eighth inch diameter, rod-shaped element. At one end 50, body 48 includes a flared shoulder 52 from which a plug, generally designated 54, projects. Shoulder 52 ramps or is angled from the longitudinal axis of body 48 at about a 36° angle. Shoulder may be shaped differently from the shown frustoconical shape within the scope of the present invention. Plug 54 serves as a module for attachment to socket 36. In the shown embodiment, plug 54 is about 0.50 inch long, is aligned axially with body 48 and is frustoconical in shape except for a pair of flattened sections 58 and 59 along its periphery. Plug 54 uniformly tapers in cross-sectional diameter away from extension body 48, or to the left in FIG. 4, at an angle of between about 5° and 30°, and more preferably about 8°. To frictionally cooperate with socket 36, at the plug inboard end 55, the conical plug portions have a diametrical dimension in a range between about 0.427 inch and 0.437 inch, and the flats 58 and 59 are spaced in a range between about 0.375 inch and 0.385 inch. At the outboard or insertion end of plug 54, the conical portions have a diametrical dimension in a range between about 0.370 inch and 0.380 inch, and the flats 58 and 59 are spaced in a range between about 0.315 inch and 0.325 inch.

At opposite end 62, body 48 terminates with a flatted round section 64 which has a generally square transverse cross-section. Other keyed configurations of section 64 may alternatively be employed. In the shown design, lug wrench 24 (see FIG. 1) includes a cooperatively shaped, square cross-sectional through bore or cavity (not shown) in its wrench arm into which flatted round section 64 may be inserted for operation. In alternate designs, instead of a connection with wrench 24, end 62 may be releasably attached to a bar which serves as a crank, or such a bar may be provided as an integral part of wrench extension 45.

Socket 36 and plug 54 are cooperatively shaped such that plug 54 nests within socket 36 when inserted therein. The facing flats provided on socket 36 and plug 54 prevent relative rotation therebetween, and consequently rotational forces are transferable from wrench extension 45 to jack extension 26. The tapering of both plug 54 and socket 36 ensures a secure, rotational force transferring engagement despite manufacturing tolerances. In specimens where socket 36 falls on the smaller side of its accepted tolerance range and plug 54 falls on the larger side of its tolerance range, the distance plug 54 inserts into socket 36 before frictionally engagement with the socket defining surfaces is less than in specimens where socket 36 is larger and plug 54 is smaller.

While both plug 54 and socket 36 are complementarily tapered to achieve an optimal engagement, only one of the socket or plug may be tapered in alternate embodiments. Furthermore, other shapes for the plugs and sockets may be employed within the scope of the invention. In situations where the extension handle assembly imparts rotational input to the jack, other complementary keyed shapes which prevent relative rotation between the handle extensions 26 and 45 may be employed. For example, sockets and plugs may be square, rectangular, triangular, pyramidal, hexagonal, octagonal, D-shaped and the like in transverse cross-section.

Figure 6:
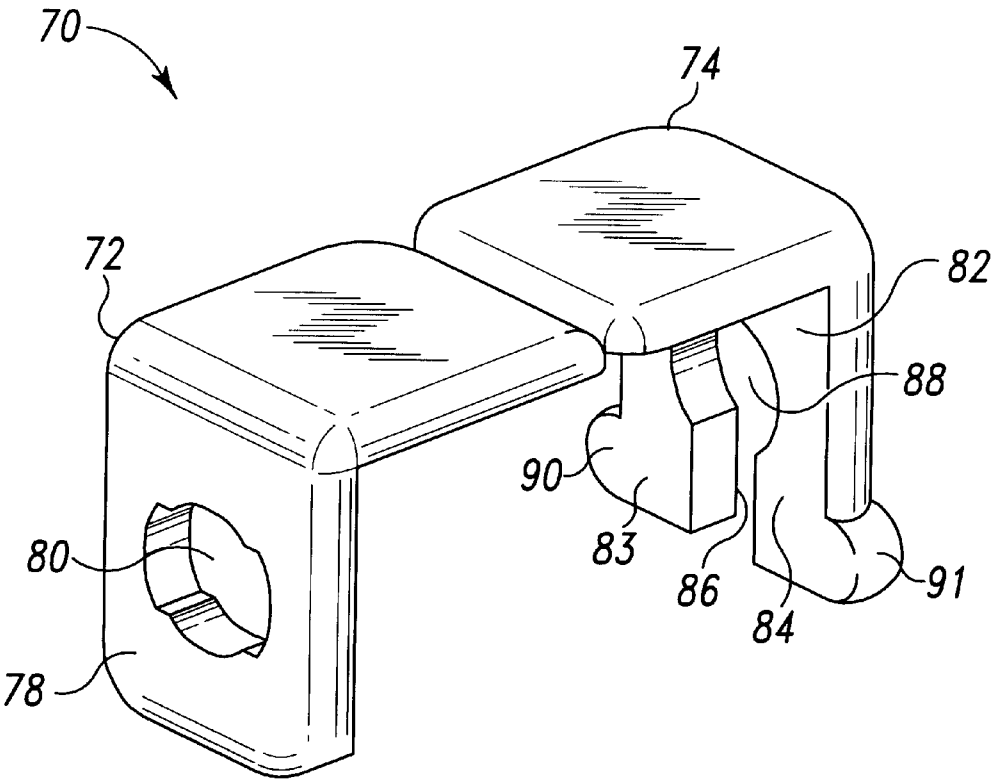
FIG. 6 is a perspective view of the extension handle retainer clip shown separate from the remainder of the extension handle assembly.

Referring now to FIG. 6, there is shown a perspective view of a preferred element of the present invention used to retain handle extensions 26 and 45 together once assembled. The retaining element is a retainer clip 70 fabricated in one piece from a resilient material, such as nylon. Retainer clip 70 includes a first angled body 72 linked to a second angled body 74 by a thin web 76 (See FIG. 7) that extends the entire width of clip bodies 72 and 74. Web 76 serves as a living hinge or joint to allow angled body 74 to be pivoted relative to angled body 72. Although shown at the center of the portion of retainer clip 70 that overlays the socket/plug connection after assembly of handle 22, hinge 76 may be positioned at other points along clip 70. Flange section 78 of clip body 72 includes an aperture 80 through which angled hook 32 and extension body 28 are insertable. Aperture 80 is sized and configured such that body 28 is frictionally engaged by clip body 72 to axially retain clip 70 on body 28. Other aperture shapes, such as a generally oval shape oriented to be elongated along the height of flange section 78, alternatively may be used to further facilitate the insertion of the hooked extension end therethrough. Flange section 82 of clip body 74 includes a pair of legs 83, 84 that define an insertion channel or passage 86 and a circular hole 88 larger in diameter than the width of channel 86. Tabs 90, 91 at the bottom corners of legs 83, 84 project laterally and serve as grips used in the release of clip body 74. Tabs 90, 91, and the lower ends of legs 83, 84 immediately adjacent tabs 90, 91, may be angled relative to flange section 82 and away from flange section 78 to be more ergonomically shaped to make them easier to grip by a user. Clip body 74 is designed to snap fit onto a handle extension as described further below. Alternate retaining means may be substituted for retainer clip 70 within the scope of the invention. For example, set screws, spring biased balls, and other known retainers, such as those disclosed in U.S. Pat. No. 5,237,890 which is incorporated herein by reference, may be substituted for retainer clip 70.

Figure 7:
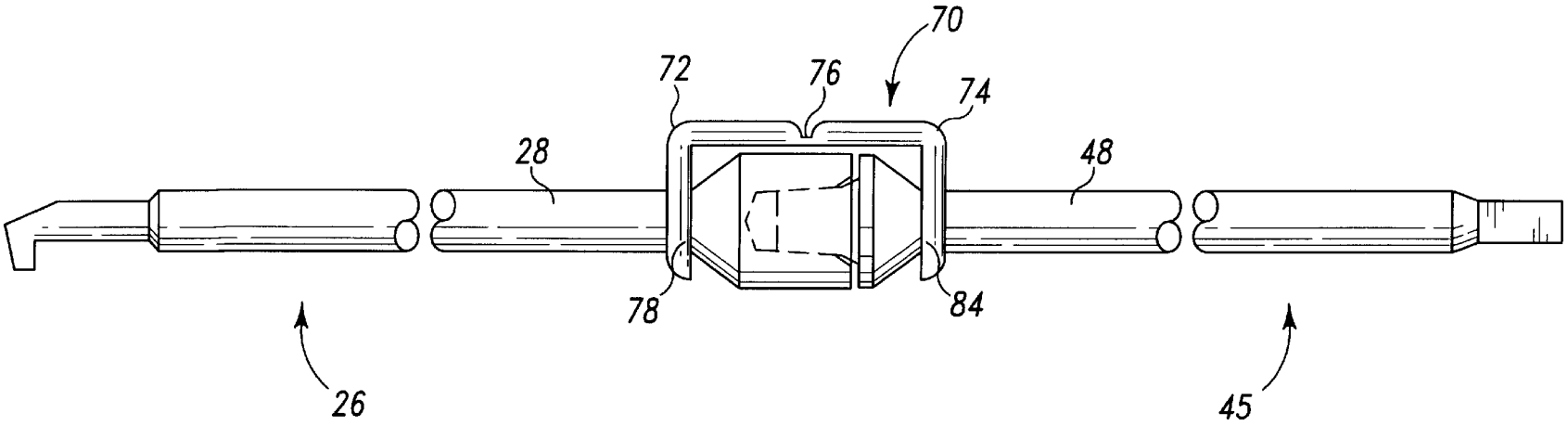
FIG. 7 is a fragmentary front view of the extension handle assembly when fully assembled for operation.

The structure of extension handle assembly 22 will be further understood in view of the following explanation of its operation. When not needed, extension handle assembly 22 may be conveniently stored in a disassembled condition in the trunk or other storage compartment of an automobile or truck along with jack 16 and wrench 24. When handle 22 is in its disassembled condition, jack side extension 26 may be stored and handled separately from wrench side extension 45. Clip 70 may be stored and handled separately from handle extensions 26 and 45, but typically will be retained on one of the extensions by the insertion of that extension through aperture 80 in flange section 78. When extension handle assembly 22 is required to operate jack 16, it may be assembled by aligning wrench extension 45 with jack extension 26 and then bringing them together such that plug 54 inserts into socket 36 with socket flats 40, 41 facing plug flats 58, 59. Plug 54 is axially inserted until its rounded periphery abuts and frictionally engages the rounded periphery of socket 36. To ensure extensions 26 and 45 remain secured together during usage, retainer clip 70 is then attached on both extensions. Clip 70 is first slid along extension 26 until flange section 78 abuts the ramped body section 29 leading to head 34. Web 76 allows angled body 74 to be pulled upward and across the interconnected socket and plug during this sliding of clip 70. Clip body 74 is then manipulated such that insertion channel 86 is aligned directly over the base of flared shoulder 52 proximate body 48. Due to the resiliency of the nylon construction of retainer clip 70, application of force on clip body 74 toward handle body 48 causes legs 83 and 84 to splay outward to widen channel 86 to accommodate extension body 48, which slides along the height of channel 86. When body 48 finally reaches the enlarged hole 88, which is sized and shaped to accommodate body 48, legs 83 and 84 snap return to their normal, unsplayed arrangement shown in FIG. 6. After this connection of retainer clip 70, jack extension handle assembly 22 is finally assembled and is arranged as shown in FIG. 7.

The conical or hex or other shape periphery of shoulder 52 helps ensure that handle extensions 26 and 45 will be held together snugly by retainer clip 70. In particular, as clip body 74 will typically be axially positioned along the base of shoulder 52 when handle extensions 26 and 45 are assembled and fully engaged, clip body 74 will need to be bent or angled slightly away from clip body 72 to be snap fit over body 48. When clip 70 is so bent, its elastic nature or tendency to return to its original shape provides a force on shoulder 52 that biases plug 54 into engagement with socket 36. The similar shape of ramped body section 29 allows body section 29 to be biased by clip body 74 when clip body 72 is mounted on extension body 48.

After assembly of handle 22 is complete, hook 32 may be inserted into jack 16 in a conventional fashion and the handle assembly 22 may be used to push jack 16 into the operational position shown in FIG. 1. Next, flatted round section 64 is inserted into its cooperating cavity or aperture in lug wrench 24. It will be appreciated that the withdrawal of plug 54 from socket 36 is prevented by retainer clip 70, which axially retains extensions 26 and 45 relative to one another. Upon manual rotation of lug wrench 24 by an operator, wrench side extension 45 is simultaneously rotated due to the keyed engagement of flatted round section 64 with wrench 24. Due to the interfitting arrangement of socket 36 and plug 54, the rotation of wrench side extension 45 is imparted to jack side extension 26, which in turn provides a rotary input to the jack to raise or lower lifting element 20 depending on the direction of rotation of lug wrench 24.

To disassemble handle assembly 22, clip part 74 is lifted such that extension body 48 is removed from hole 88 and channel 86. The jack and wrench extensions 26 and 45 may then be pulled apart and stored.

In situations where longer extension handles are required, one or both of extensions 26 and 45 may be manufactured longer. Alternatively, additional extensions with appropriate modules allowing for connection with handle extensions 26 and 45 may be employed. For example, an additional extension fitting between jack extension 26 and wrench extension 45, and which therefore would include a socket at one end and a plug at the other end, may be employed within the scope of the present invention. In addition, other extension configuration having suitable plug and/or socket elements may be employed within the scope of the present invention.

Figure 8:
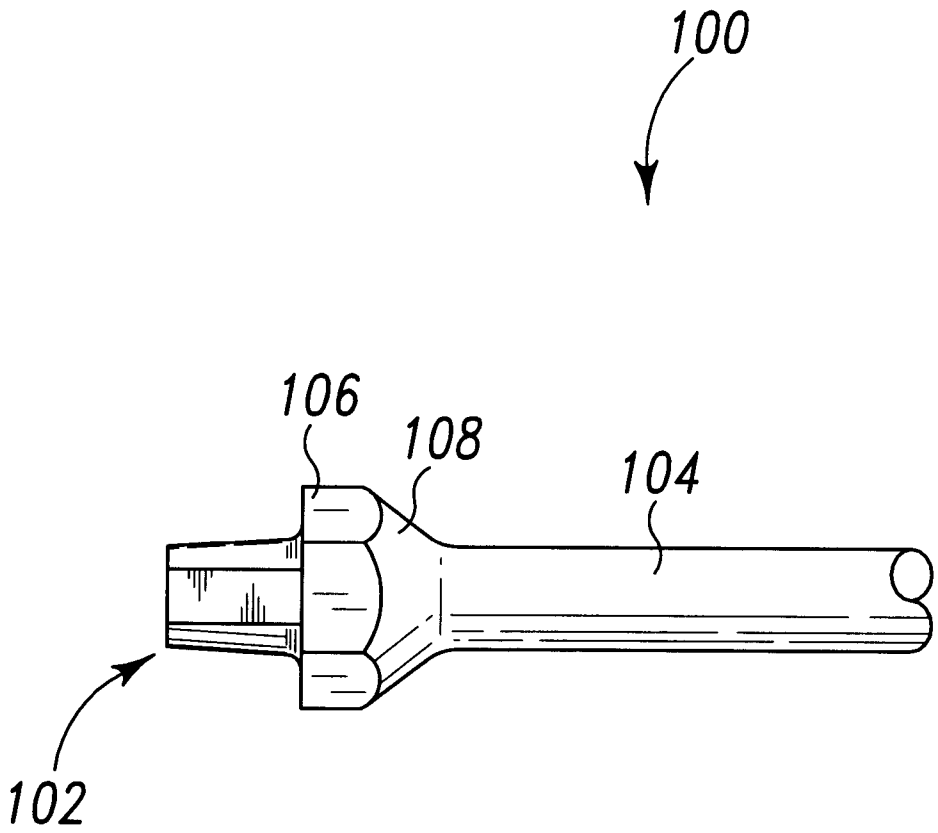
FIG. 8 is a partial front view of an alternate embodiment of a wrench side extension of the extension handle assembly.

Referring now to FIG. 8, there is shown a front view of a portion of an alternate embodiment of an extension of the present invention provided with a socket engageable plug. This extension 100, which includes a plug generally designated 102 and a rod-shaped body 104, is similar to wrench side extension 45 except for a differently shaped shoulder. Rather than a cylindrical shoulder base as provided in extension 45, shoulder base 106 has a hexagonal periphery which blends into a conically shaped, sloping shoulder portion 108 that terminates at body 104. Shoulder portion 108 may be differently shaped, such as with a more hexagonal cross-sectional shape. Hexagonal shoulder base 106 is a five-eighth inch hex head and is adapted to allow operation of another mechanism which may be provided on vehicles. For example, for vehicles such as some pick-up trucks equipped with a hexagonal socket near the bumper which is operatively connected to a mechanism which raises and lower a spare tire from a storage location beneath the vehicle, extension 100 may be used to access the tire. After inserting the plug end of extension 100 into the vehicle socket such that hexagonal shoulder base 106 closely fits into that socket, the lug wrench is attached to extension 100 in a similar fashion to the attachment of the wrench with extension 45 described above. The subsequent rotation of the wrench, and thereby the extension 100, causes the socket engaged by shoulder base 106 to rotate and selectively move the spare tire.

While this invention has been shown and described as having multiple designs, the present invention may be further modified within the spirit and scope of this disclosure. For example, the plug and socket may be placed on the extensions opposite to the extensions shown. In addition, clip flange section 78 may be modified to be similar to shown flange section 82. Moreover, a hexagonal periphery adapted to engage a socket found on a vehicle may be provided in the extension including the plug-receiving socket. This application is therefore intended to cover any variations, uses, or adaptations of the invention using its general principles. Further, this application is intended to cover such departures from the present disclosure as come within known or customary practice in the art to which this invention pertains.

What is claimed is:

1. A jack extension handle assembly comprising:

a first extension having a first elongated body, a first engagement portion, and a first shoulder, said first shoulder extending radially outward from said first elongated body, said first elongated body comprising a solid rod;

a second extension having a second elongated body, a second engagement portion extending axially outward from said second elongated body, and a second shoulder intermediate said second elongated body and said second engagement portion, said second shoulder extending radially outward from said second elongated body;

said first engagement portion selectively engaged with said second engagement portion;

one of said first extension and said second extension selectively attached to a jack; and a resilient, single-piece retainer in selective abutting engagement with said first shoulder and said second shoulder, said first and second engagement portions retained in engagement by said retainer to define an elongated jack handle.

2. The jack extension handle assembly of claim 1 wherein said retainer comprises a clip selectively attached to said first and second extensions, said clip structured to substantially surround one of said first and second elongated bodies, and to at least partially surround the other of said first and second elongated bodies.

3. The jack extension handle assembly of claim 1 wherein said first and second shoulders comprise a tapered construction, said first and second shoulders tapering away from said first and second engagement portions, respectively.

4. A jack extension handle assembly comprising:

a first extension attachable to a jack to enable jack operation, said first extension including an elongated body and a first attachment element;

a second extension to transfer input force to said first extension, said second extension including an elongated body and a second attachment element;

wherein one of said first and second attachment elements comprises a socket and the other of said first and second attachment elements comprises a plug, wherein said first extension and said second extension are connectable in an operative arrangement by inserting said plug into said socket, and wherein said first extension and said second extension are storable in a reduced length arrangement when said plug is removed from said socket; and a retainer clip including a first clip portion, a second clip portion and a bridging portion extending between said first and second clip portions, wherein said first and second clip portions are attachable to said first and second extensions respectively when said first and second extensions are arranged in said operative arrangement such that said bridging portion extends over said inserted plug and socket, whereby said retainer clip releaseably secures together said first and second extensions to prevent removal of said plug from said socket.

5. The jack extension handle assembly of claim 4 wherein said bridging portion comprises a hinge to permit pivoting of said first clip portion relative to said second clip portion.

6. The jack extension handle assembly of claim 5 wherein said retainer clip comprises a one-piece construction from a resilient material, and wherein said bridging portion hinge comprises a living hinge.

7. The jack extension handle assembly of claim 4 wherein said first clip portion comprises first and second legs defining an insertion channel with an enlarged base opening, wherein at least one of said legs comprises a resilient construction to allow said insertion channel to be expanded during attachment of said first clip portion to said first extension, said first clip portion sized and configured to snap fit onto said first extension when said first extension is introduced through said insertion channel and into said enlarged base opening.

8. The jack extension handle assembly of claim 7 wherein said second clip portion comprises an aperture through which said second extension slidably inserts.

9. The jack extension handle assembly of claim 4 wherein said socket and said plug each comprise a taper, said tapers being complementary to provide for a frictional engagement between said plug and said socket when said first extension and said second extension are disposed in said operative arrangement.

10. The jack extension handle assembly of claim 9 wherein said elongated bodies of said first and second extensions comprise rods along their respective lengths.

11. The jack extension handle assembly of claim 4 wherein said first extension comprises a flared shoulder for engaging said retainer clip.

12. The jack extension handle assembly of claim 11 wherein said flared shoulder comprises a base with a hexagonal periphery.

13. A jack extension handle assembly comprising a first handle extension, a second handle extension, means integrated into said first and second handle extensions for releasably interconnecting together said first and second handle extensions for transfer of rotational energy, said interconnecting means comprising a tapered plug and a tapered socket, and means for retaining said first and second handle extensions in an operational interconnection.

* * * * *

UNITED STATES PATENT AND TRADEMARK OFFICE

CERTIFICATE OF CORRECTION

PATENT NO : 6,070,491

DATED : June 6, 2000

INVENTOR(S) : Mark H. Claudio et al.

It is certified that error appears in the above-identified patent and that said Letters Patent are hereby corrected as shown below:

Please make the following correction of record in the file wrapper of the above identified patent:

Claim 13, column 10, please delete the entire claim 13 and substitute therefor:

--A jack extension handle assembly comprising:

a first extension having a first engagement portion unitary with said first extension;

a second extension having a second engagement portion unitary with said second extension;

one of said first extension and said second extension selectively attached to a jack;

said first and second engagement portions releaseably interconnecting together said first and second extensions for transfer of axial rotation between said first and second extensions; and a clip surrounding one of said first and second extensions and surrounding the other of said first and second extensions, said clip retaining said first and second extensions in an operational interconnection to define an elongated jack handle.--

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,070,491
DATED : July 25, 2000
INVENTOR(S) : Mark H. Claudio et al.

It is certified that error appears in the above-identified patent and that said Letters Patent is hereby corrected as shown below:

Please make the following correction of record in the file wrapper of the above identified patent:

Claim 13,
Column 10, please delete the entire claim 13 and substitute therefor:

-- A jack extension handle assembly comprising:
a first extension having a first engagement portion unitary with said first extension;
a second extension having a second engagement portion unitary with said second extension;
one of said first extension and said second extension selectively attacked to a jack;
said first and second engagement portions releaseably interconnecting together said first and second extensions for transfer of axial rotation between said first and second extensions; and a clip surrounding one of said first and second extensions and surrounding the other of said first and second extensions, said clip retaining said first and second extensions in an operational interconnection to define an elongated jack handle. --

Signed and Sealed this

Twenty-third Day of October, 2001

*Attest:*

Nicholas P. Godici

NICHOLAS P. GODICI
*Acting Director of the United States Patent and Trademark Office*

*Attesting Officer*